US007934409B2

(12) United States Patent
Wang et al.

(10) Patent No.: US 7,934,409 B2
(45) Date of Patent: May 3, 2011

(54) METAL STRUCTURE DEFINING CIRCULAR FLANGED HOLE AND METHOD FOR MAKING THE SAME

(75) Inventors: Wen-Tao Wang, Shenzhen (CN); Cheng-Hung Lin, Taipei Hsien (TW); Zhi-Gang Hu, Shenzhen (CN); Yong Zeng, Shenzhen (CN); Zhi-Guo Yang, Shenzhen (CN); Ming-Gang Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 431 days.

(21) Appl. No.: 11/944,463

(22) Filed: Nov. 23, 2007

(65) Prior Publication Data

US 2008/0231050 A1 Sep. 25, 2008

(30) Foreign Application Priority Data

Mar. 21, 2007 (CN) ..... 2007 1 0200313

(51) Int. Cl.
*B21D 31/02* (2006.01)
*B21D 28/02* (2006.01)

(52) U.S. Cl. ..... 72/340; 72/325

(58) Field of Classification Search ..... 72/324, 72/325, 326, 327, 332, 333, 334, 338, 340, 72/70, 71

See application file for complete search history.

(56) References Cited

U.S. PATENT DOCUMENTS 4,184,355 A * 1/1980 Kozima ..... 72/327
4,454,741 A * 6/1984 Hoogenboom ..... 72/71
4,719,780 A * 1/1988 Ristimaki ..... 72/71

FOREIGN PATENT DOCUMENTS

CN 2201188 Y 6/1995
CN 1442266 A 9/2003

* cited by examiner

*Primary Examiner* — Debra M Sullivan
(74) *Attorney, Agent, or Firm* — Frank R. Niranjan

(57) ABSTRACT

An exemplary metal structure (10, 30) includes a base portion (14, 34), a flange (122, 322), and an edge portion (1241, 3241). The base portion defines a circular flanged hole (12, 32). The flange extends from a top surface of the base portion and the flange surrounds the circular flanged hole. The edge portion is configured for connecting an inside surface of the flange and the top surface of the base portion. The edge portion includes an edge surface, and a ratio of a radius of the edge surface (1242, 3242) of the edge portion with respect to a thickness of the base portion is less than 0.4. A method for making a circular flanged hole in a metal sheet (15) is also provided.

8 Claims, 9 Drawing Sheets

METAL STRUCTURE DEFINING CIRCULAR FLANGED HOLE AND METHOD FOR MAKING THE SAME

BACKGROUND OF THE INVENTION

1. Field of the Invention

The present invention generally relates to metal structures and methods for making the same, and more particularly, to a metal structure defining a circular flanged hole and a method for making the same.

2. Discussion of the Related Art

Circular holes surrounded by flanges are called circular flanged holes. In the customary way of producing flanges surrounding circular holes in metal structures such as deformable metal sheets, it is customary first to pierce or define a preformed hole in the metal structure and then displace portions of the metal structures surrounding the circular hole from a surface of the metal structure to form the flange.

A typical method for making a circular flanged hole in a metal structure such as a sheet or a header plate will now be described. Firstly, a portion of a metal structure is cut out from the metal structure forming a preformed hole in the metal structure. Secondly, a circumferential portion of the preformed hole of the metal structure is deformed and displaced from a surface of the metal structure by a cylinder punch to form a flange. After the two steps, a flanged hole is formed in the metal structure. However, when using the typical method, a collapse portion is generally formed on an edge portion of the flanged hole because of high circumferential tensile deformation caused by the cylinder punch. In addition, if any impurity particles are accidentally adhered to the cylinder surface of the cylinder punch or if the cylinder punch is scratched, the circular flanged hole will be scratched, thus, decreasing the quality of the flanged hole. Furthermore, because the shape of the flanged hole is determined by the cross-section of the cylinder punch, the cross-section of the cylinder punch should be circular, or the shape of the flanged hole would not be circular.

Therefore, a metal structure defining a circular flanged hole is desired in order to overcome the above-described shortcomings. A new method for making a circular flanged hole in a metal sheet is also desired.

SUMMARY

In one aspect, a metal structure includes a base portion, a flange, and an edge portion. The base portion defines a circular flanged hole. The flange extends from a top surface of the base portion and the flange surrounds the circular flanged hole. The edge portion is configured for connecting an inside surface of the flange and the top surface of the base portion. The edge portion includes an edge surface, and a ratio of a radius of the edge surface of the edge portion with respect to a thickness of the base portion is less than 0.4.

In another aspect, a method for making a circular flanged hole in a metal sheet, includes: punching through a metal sheet to form a preformed hole by a first punch; punching a circumferential portion of the preformed hole by a second punch to form a protruded portion, and a size of the second punch is larger than that of the first punch; and forming a flange surrounding the preformed hole by a third punch.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present metal structure (and method). Moreover, in the drawings, like reference numerals designate corresponding parts throughout the several views, and all the views are schematic.

DETAILED DESCRIPTION OF THE EMBODIMENTS

Reference will now be made to the drawings to describe preferred embodiments of the present metal structure defining a circular flanged hole in detail.

Figure 1:
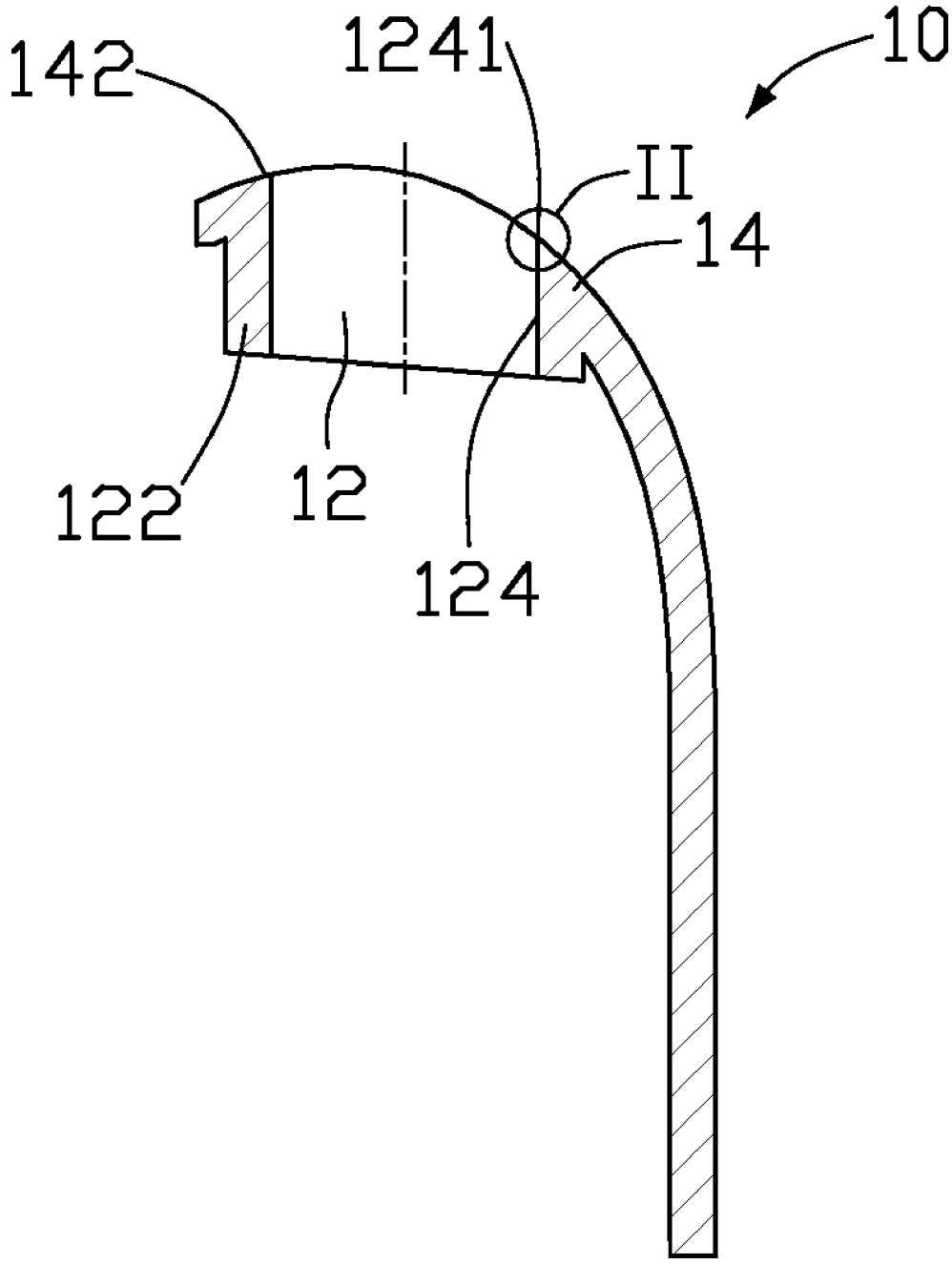
FIG. 1 is a cross-sectional view of a metal structure defining a circular flanged hole in accordance with a first preferred embodiment of the present invention.
Figure 2:
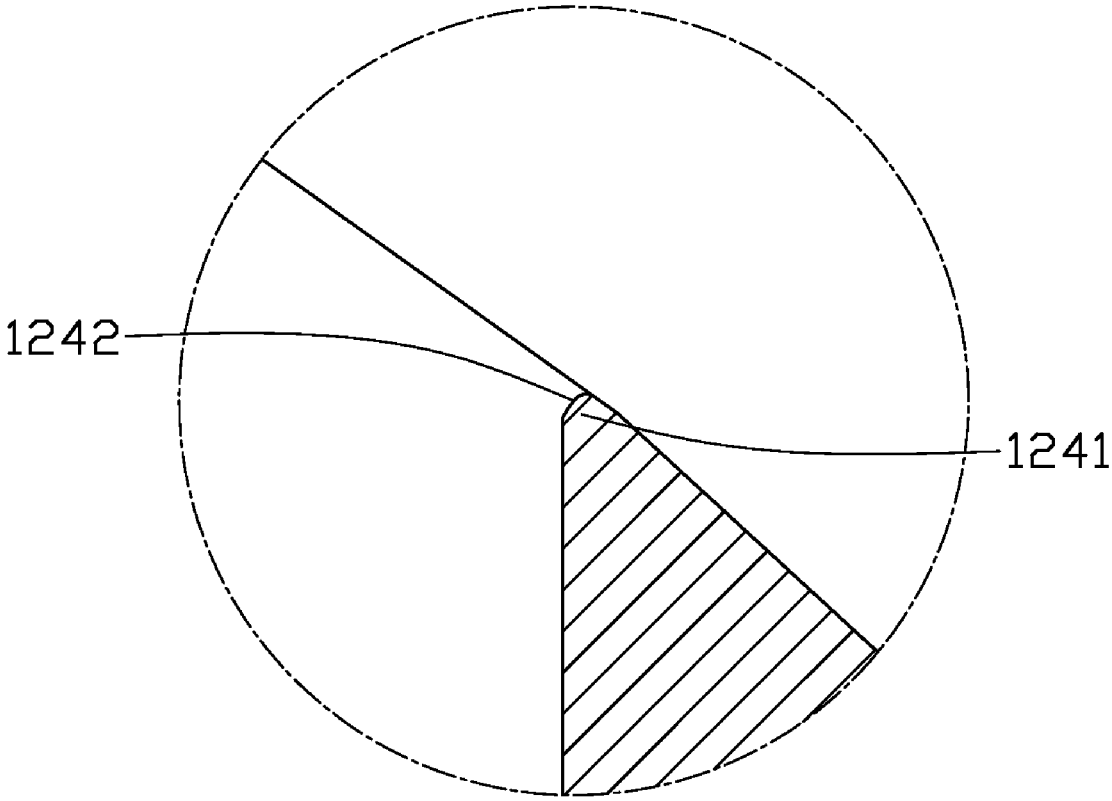
FIG. 2 is an enlarged view of an encircled portion 11 shown in FIG. 1.

Referring to FIGS. 1 and 2, a metal structure 10 defining a circular flanged hole 12 in accordance with a first preferred embodiment is shown. The metal structure 10 includes a base portion 14 having a rounded top surface 142. In this embodiment, the rounded surface 142 is convex, however, the rounded top surface 142 can also be concave. The circular flanged hole 12 is surrounded by a flange 122 that extends from the rounded top surface 142. The flange 122 includes an inside surface 124 in the circular flanged hole 12. The metal structure 10 includes an edge portion 1241 connecting the inside surface 124 and the rounded top surface 142. The edge portion 1241 includes an edge surface 1242. The edge surface 1242 is substantially a rounded surface. A ratio of a radius of the edge surface 1242 of the edge portion 1241 with respect to a thickness of the base portion 14 is less than 0.4. For example, if the thickness of the base portion 14 is 10 mm, the radius of the edge surface 1242 will be less than 4 mm. The ratio of the radius of the edge surface 1242 of the edge portion 1241 with respect to the thickness of the base portion 14 is preferred to be less than 0.2, thus the edge portion 1241 is substantially sharp-cornered edge.

The metal structure 10 is made of metallic materials such as steel, aluminum, aluminum alloy, magnesium alloy, copper, and the like.

Figure 3:
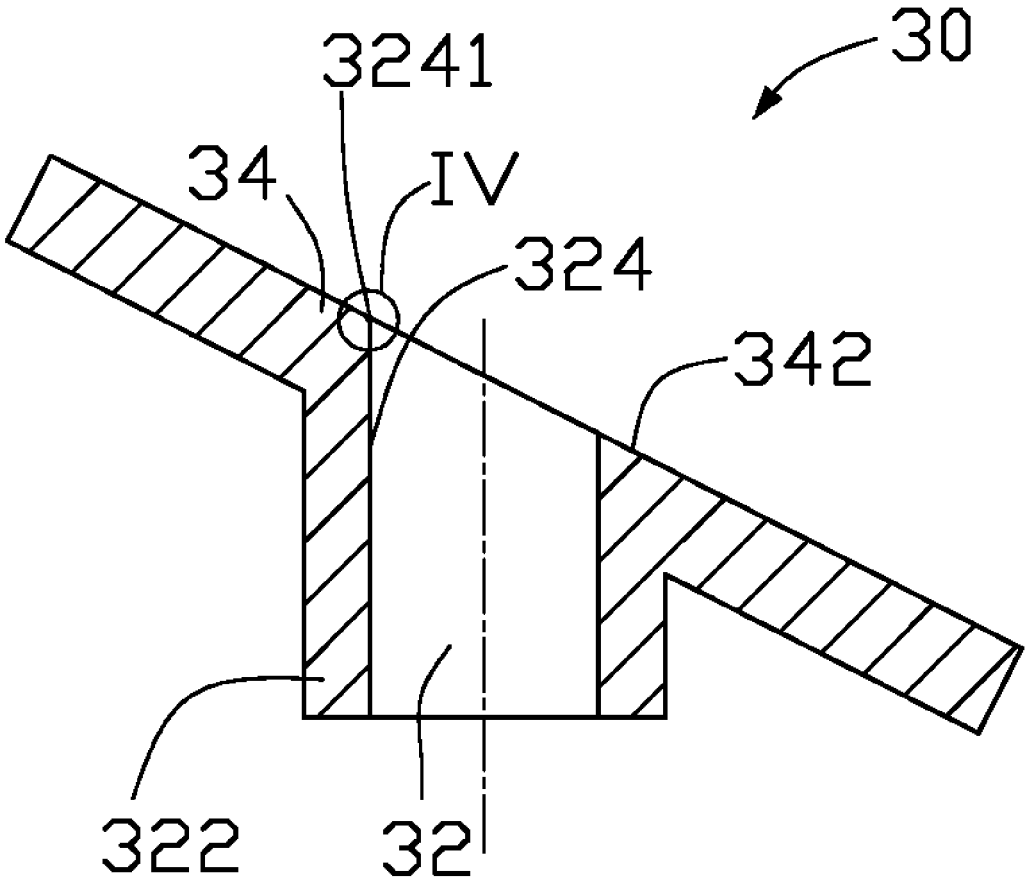
FIG. 3 is a cross-sectional view of a metal structure defining a circular flanged hole in accordance with a second preferred embodiment of the present invention.
Figure 4:
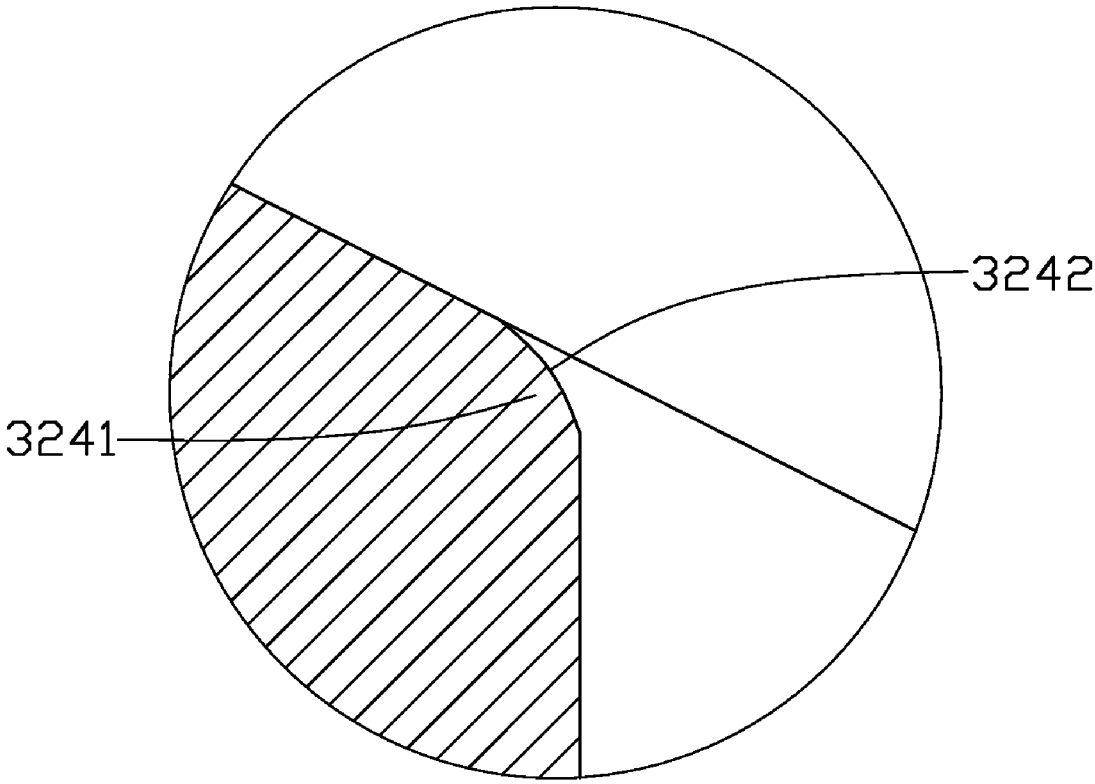
FIG. 4 is an enlarged view of an encircled portion IV shown in FIG. 3.

Referring to FIGS. 3 and 4, a metal structure 30 defining a circular flanged hole 32 in accordance with a second preferred embodiment is shown. The metal structure 30 includes a base portion 34 having a flat top surface 342 that is substantially flat. The circular flanged hole 32 is surrounded by a flange 322 that extends from the flat top surface 342. The flange 322 includes an inside surface 324 in the circular flanged hole 32. The inside surface 324 is oblique to the flat top surface 342. The metal structure 30 includes an edge portion 3241 connecting the inside surface 324 and the flat top surface 342. The edge portion 3241 includes an edge surface 3242. The edge surface 3242 is substantially a rounded surface. A ratio of a radius of the edge surface of the edge portion 3241 with respect to a thickness of the base portion 34 is less than 0.4. The ratio of the radius of the edge surface 3242 of the edge portion 3241 with respect to the thickness of the base portion 34 is preferred to be less than 0.2, thus the edge portion 3241 is substantially a sharp-cornered edge.

An exemplary method for making any of the above-described metal structures 10, and 30 will now be described as follows. The metal structure 10 of the first embodiment is taken here as an exemplary application, for the purposes of conveniently describing details of the exemplary method.

Figure 5:
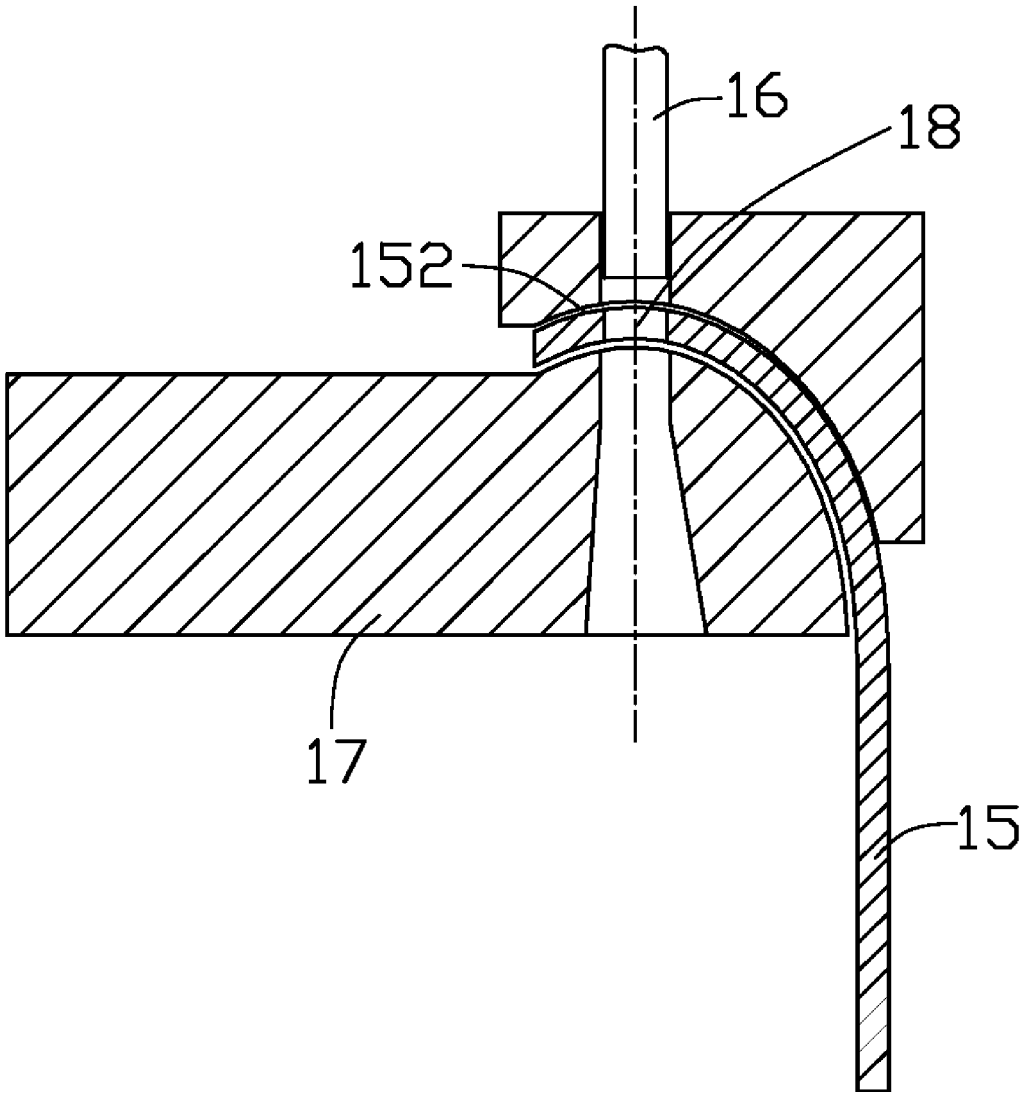
FIG. 5 illustrates a first step in the practice of the method in accordance with the preferred embodiment of the present invention.

Referring to FIG. 5, in a first step, a metal sheet 15 including a rounded top surface 152 is provided. The metal sheet 15 is fixed by a clamping device 17. A first punch 16 is provided to punch through the rounded top surface 152 of the metal sheet 15, thus a preformed hole 18 is defined in the metal sheet 15. A size of the preformed hole 18 is less than that of the circular flanged hole 12. The preformed hole 18 can also be formed by a twist drill bit.

Figure 6:
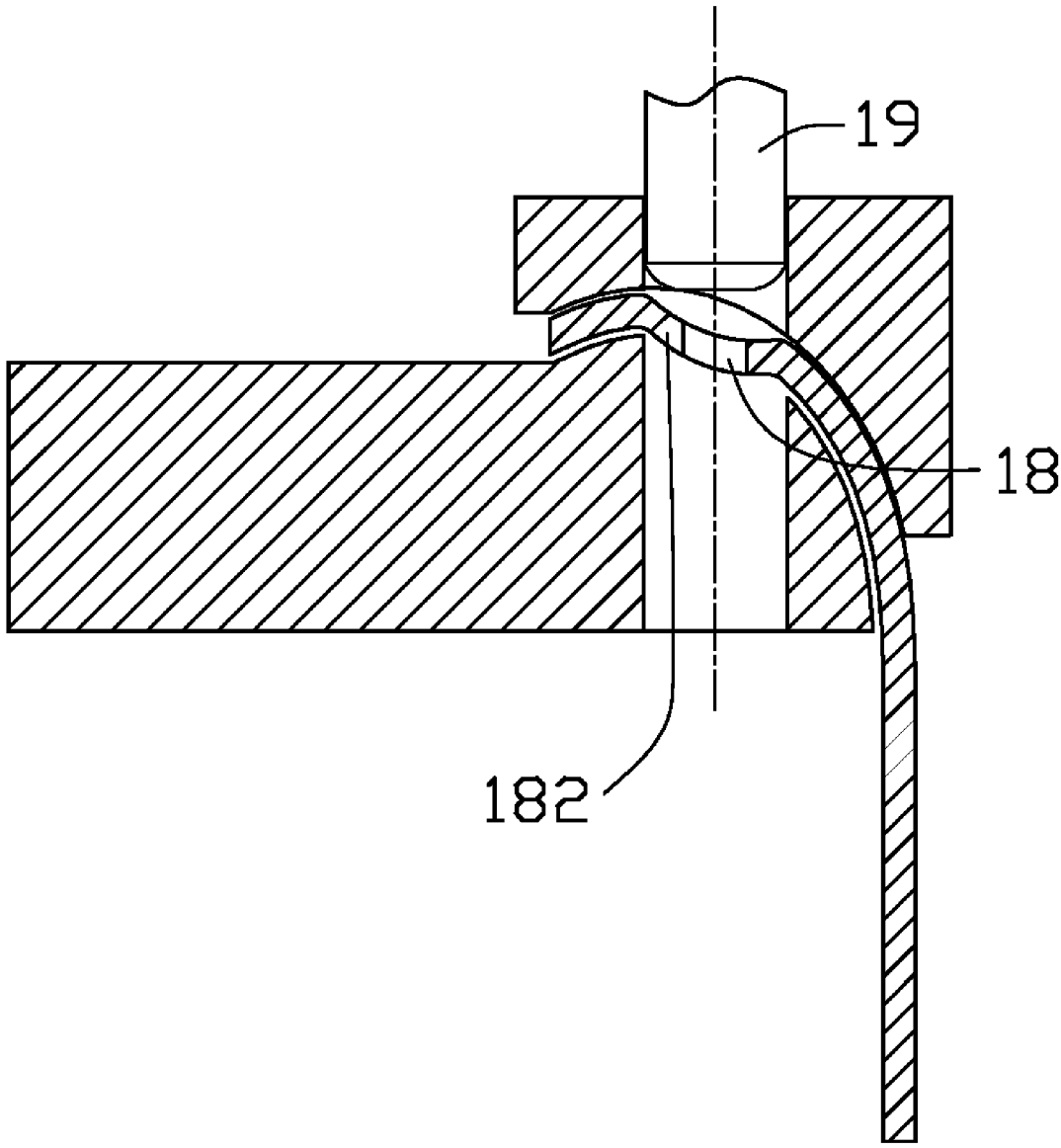
FIG. 6 illustrates a second step in the practice of the method in accordance with the preferred embodiment of the present invention.

Referring to FIG. 6, in a second step, a second punch 19 is provided to punch a circumferential portion of the preformed hole 18 to form a protruded portion 182. A size of the second punch 19 is larger than that of the first punch 16. The protruded portion 182 is larger than the preformed hole 18.

Figure 7:
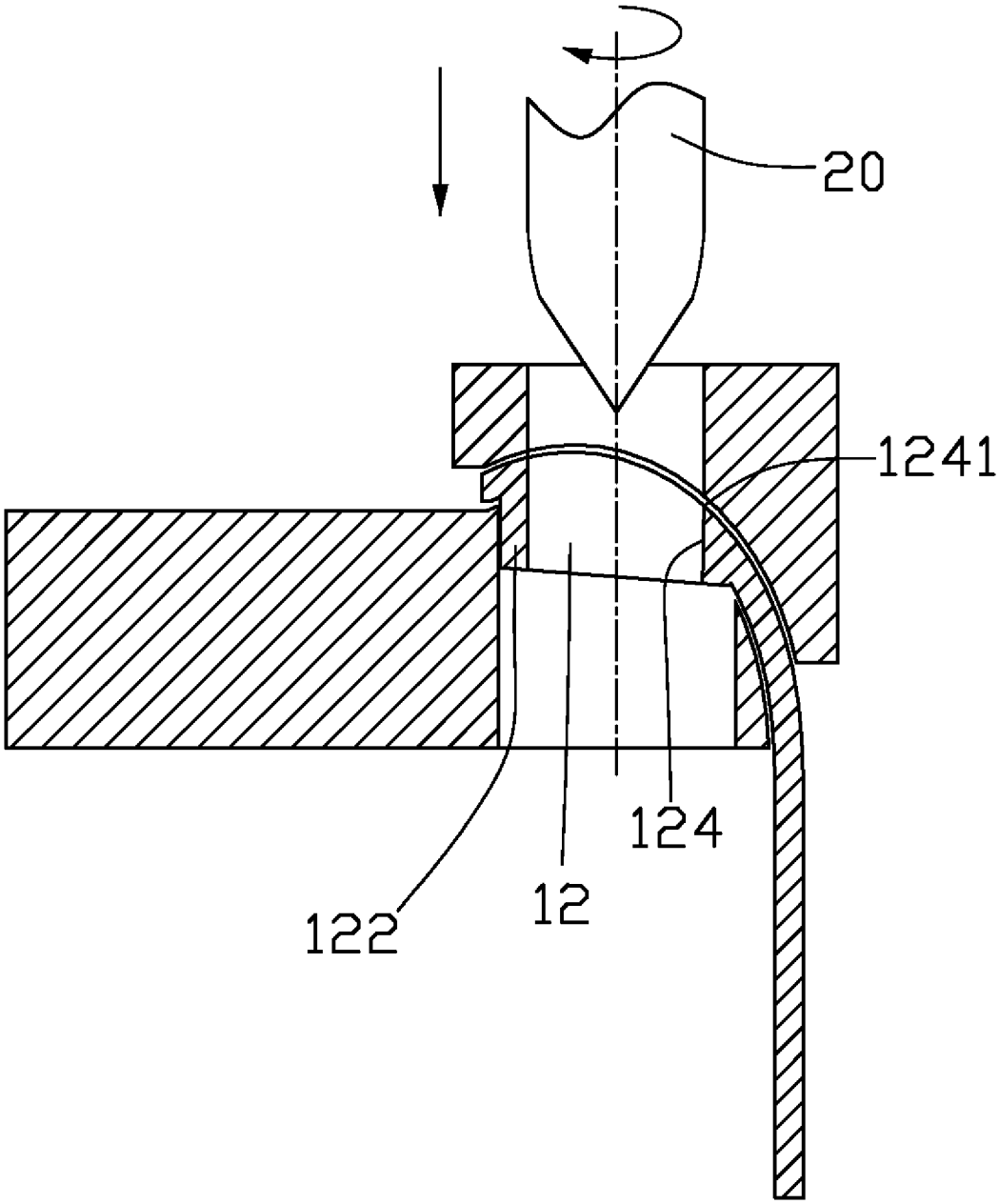
FIG. 7 illustrates a third step in the practice of the method in accordance with the preferred embodiment of the present invention.

Referring also to FIG. 7, in a third step, the preformed hole 18 is made into the flanged hole 12 by a third punch 20. In the process of making the preformed hole 18 into the flanged hole 12, the third punch 20 is first aimed at the preformed hole 18. The third punch 20 is driven by a driving device (not shown) such as a motor, thus the third punch 20 is gradually drilled into the preformed hole 18. The metallic material adjacent to the preformed hole 18 is gradually displaced by the third punch 20 forming the flange 122, thus, the preformed hole 18 is made into the flanged hole 12. The third punch 20 is rotatedly moved to enlarge the preformed hole 18, thereby preventing the inside surface 124 of the flange 122 from being scratched by any impurity particles accidentally adhered to the third punch 20. Furthermore, the shape of the circular flanged hole 12 will be circular even if the drill bit 20 is scratched or abraded, thereby increasing the quality of the inside surface 124 of the flange 122.

Figure 8:
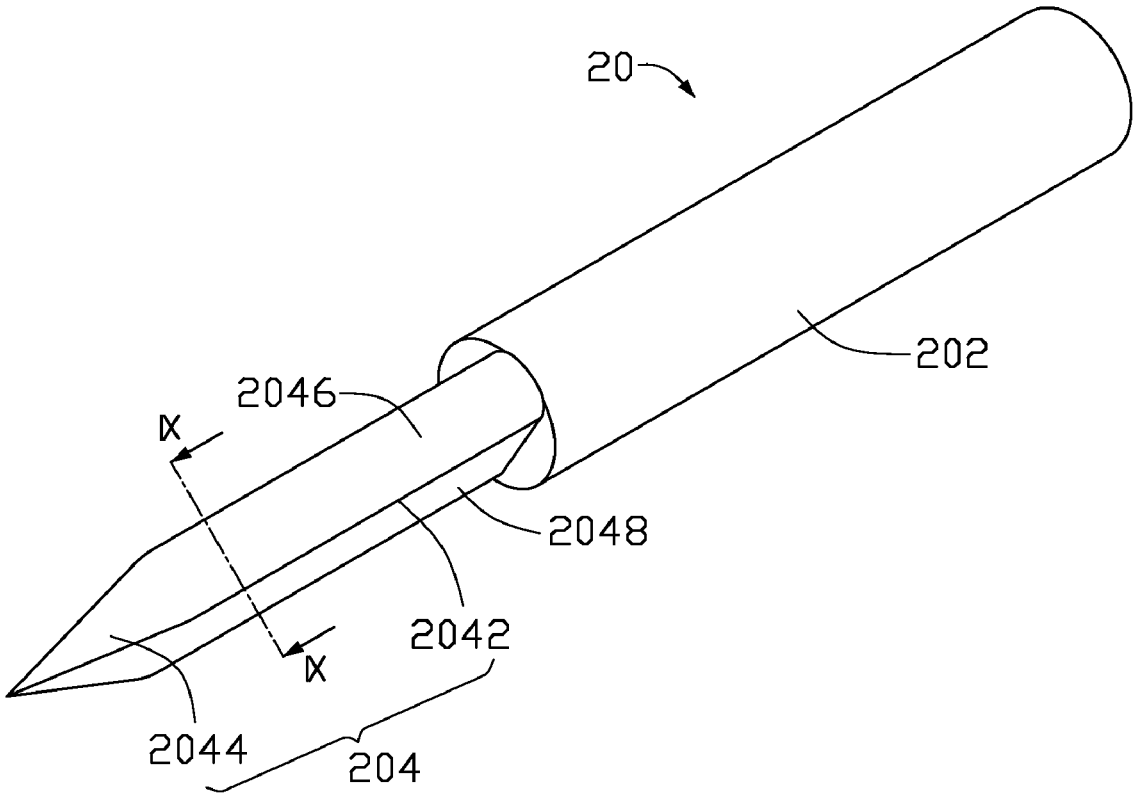
FIG. 8 is an isometric view of a punch used in third step of the method in accordance with the preferred embodiment of the present invention.
Figure 9:
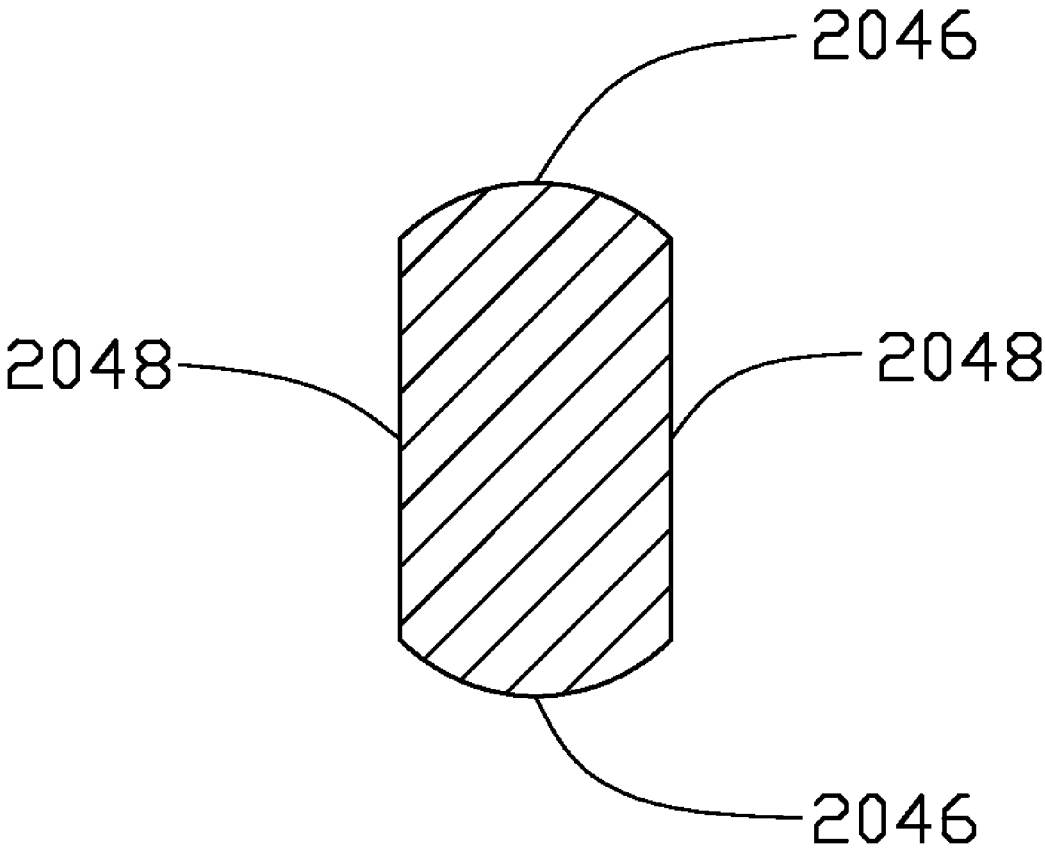
FIG. 9 is a cross-sectional view of the punch shown in FIG. 8, taken along line IX-IX thereof.

Referring to also FIG. 8, the third punch 20 includes a shank portion 202 and a drill portion 204. The drill portion 204 extends from one end of the shank portion 202. The shank portion 202 is cylindrical and has a size larger than that of the drill portion 204. The shank portion 202 is configured for connecting to the driven device. The drill portion 204 includes a displacing portion 2042 connecting the end of the shank portion 202 and a starting point 2044 adjoining the displacing portion 2042. The starting point 2044 is smaller than the displacing portion 2042. Referring to FIG. 9, a cross-section of the displacing portion 2042 is shown, the displacing portion 2042 includes a pair of rounded surfaces 2046 opposite to each other and a pair of flat surfaces 2048 opposite to each other. The rounded surfaces 2046 and the flat surfaces 2048 form four edges (not labeled). The rounded surfaces 2046 and the flat surfaces 2048 connect to each other. In the illustrated embodiment, the starting point 2044 is a pyramidal portion extending from an end of the displacing portion 2042.

As described above, the third punch 20 drills into the preformed hole 18, thus the displacing portion 2042 and the starting point 2044 successively displace the material adjoining the preformed hole 18 to form the flange 122. When the third punch 20 rotates in the preformed hole 18, a friction is produced between the material adjoining the preformed hole 18 and the third punch 20, thereby increasing the temperature of the material adjoining the preformed hole 18. The material adjoining the preformed hole 18 gets softened because of increase of the temperature, thus ductility of the material is improved and tensile deformation of the material is reduced. Therefore, the quality of the flanged hole 12 is greatly improved, for example, the edge portion 1241 of the flanged hole 12 is substantially sharp-cornered edge, and $R/T<0.4$ or even less than 0.2, wherein R represents the radius of the edge surface 1242 of the edge portion 1241 and T the represents the thickness of the base portion.

In alternative embodiments, the displacing portion 2042 of the drill portion 204 are other shapes such as a regular triangular prism, and a regular pentagonal prism. The rounded top surface 142 of the base portion 14 is replaced by a flat top surface. The inside surface 324 is perpendicular to the flat top surface 342. Thus, in the method for making such metal structure, the second step for forming a protruded portion is omitted correspondingly.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method for making a circular flanged hole in a metal sheet, comprising:

punching through a metal sheet to form a preformed hole by a first punch;

punching a circumferential portion of the preformed hole by a second punch to form a protruded portion, and a size of the second punch is larger than that of the first punch; and forming a flange surrounding the preformed hole by a third punch, wherein the third punch comprises a shank portion and a non-circular cross section drill portion extending from one end of the shank portion, and the shank portion is cylindrical and has a circumference larger than that of the non-circular cross-section drill portion, wherein the flange is formed by rotating the third punch with the non-circular cross-section drill portion to displace the material adjacent to the performed hole.

2. The method as claimed in claim 1, wherein the metal sheet comprises a rounded surface, and the first punch punches though the rounded surface.

3. The method as claimed in claim 1, wherein the metal sheet comprises a flat top surface, and the first punch punches through the flat top surface.

4. The method as claimed in claim 1, wherein the drill portion includes a displacing portion connecting to the end of the shank portion and a starting point smaller than the displacing portion and adjoining the displacing portion.

5. The method as claimed in claim 4, wherein the starting point is a pyramidal portion extending from an end of the displacing portion.

6. The method as claimed in claim 5, wherein the displacing portion comprises a pair of rounded surfaces opposite to each other and a pair of flat surfaces opposite to each other, the rounded surfaces and flat surfaces being connected to each other thereby forming four edges.

7. The method as claimed in claim 4, wherein a cross-section of the displacing portion has a triangular prism shape.

8. The method as claimed in claim 4, wherein a cross-section of the displacing portion has a pentagonal prism shape.

* * * * *